US010876536B2

(12) United States Patent
Torkildsen

(10) Patent No.: US 10,876,536 B2
(45) Date of Patent: Dec. 29, 2020

(54) SURGE FREE SUBSEA COMPRESSOR

(71) Applicant: ONESUBSEA IP UK LIMITED, Houston, TX (US)

(72) Inventor: Bernt-Helge Torkildsen, Bergen (NO)

(73) Assignee: ONESUBSEA IP UK LIMITED, London (GB)

( * ) Notice: Subject to any disclaimer, the term of this patent is extended or adjusted under 35 U.S.C. 154(b) by 434 days.

(21) Appl. No.: 14/807,531

(22) Filed: Jul. 23, 2015

(65) Prior Publication Data

US 2017/0022994 A1 Jan. 26, 2017

(51) Int. Cl.

| | |
|---|---|
| ***F04D 25/06*** | (2006.01) |
| ***F04D 29/32*** | (2006.01) |
| ***F04D 19/02*** | (2006.01) |
| ***F01D 5/14*** | (2006.01) |
| ***F04D 19/00*** | (2006.01) |

(52) U.S. Cl.

CPC ..... *F04D 25/0686* (2013.01); *F01D 5/142* (2013.01); *F04D 19/007* (2013.01); *F04D 19/024* (2013.01); *F04D 29/321* (2013.01); *F04D 29/324* (2013.01)

(58) Field of Classification Search

CPC .. F04D 25/0686; F04D 19/024; F04D 19/007; F04D 27/0207; F04D 27/023; F04D 29/324; F04D 29/321; F01D 5/142

See application file for complete search history.

(56) References Cited

U.S. PATENT DOCUMENTS

| | | | | |
|---|---|---|---|---|
| 4,721,394 | A * | 1/1988 | Casto | B01F 7/00341 366/330.2 |
| 4,840,540 | A * | 6/1989 | Kallergis | B64C 11/16 415/119 |
| 6,488,238 | B1 | 12/2002 | Battisti | |
| 8,016,567 | B2 * | 9/2011 | Praisner | F01D 5/145 416/231 R |
| 8,777,580 | B2 * | 7/2014 | Eisenberg | F03D 1/0633 416/239 |
| 9,278,753 | B2 * | 3/2016 | Reckzeh | B64C 21/02 |

(Continued)

FOREIGN PATENT DOCUMENTS

| | | | |
|---|---|---|---|
| CA | 1198681 | A | 12/1985 |
| EP | 2824330 | A1 | 1/2015 |
| WO | 2014/083055 | A2 | 6/2014 |

OTHER PUBLICATIONS

International Patent Application No. PCT/EP2016/062418 International Search Report and Written Opinion dated Oct. 17, 2016 (14 pages).

(Continued)

*Primary Examiner* — Woody A Lee, Jr.
*Assistant Examiner* — Justin A Pruitt
(74) *Attorney, Agent, or Firm* — Helene Raybaud

(57) ABSTRACT

A compressor includes impellers each having its chord angle less than its stall angle. The impellers can be used in a contra-rotating impeller arrangement without static diffusers. The contra-rotating impeller arrangement provides for much larger nominal flow rates than conventional single rotating impeller arrangements with the same chord angles. Accordingly, a surge free design is provided without excessively compromising the nominal flow rate. Techniques for enhancing stall characteristics of the impellers are also described.

8 Claims, 13 Drawing Sheets

(56) References Cited

U.S. PATENT DOCUMENTS

| | | | | |
|---|---|---|---|---|
| 9,476,427 | B2 | 10/2016 | Torkildsen et al. | |
| 2004/0096320 | A1 | 5/2004 | Yevtushenko et al. | |
| 2006/0140760 | A1 | 6/2006 | Saddoughi et al. | |
| 2009/0169391 | A1 | 7/2009 | Iida et al. | |
| 2010/0303634 | A1* | 12/2010 | Long | B63B 35/7926 416/90 A |
| 2011/0229322 | A1* | 9/2011 | Tadayon | F03D 1/065 416/91 |
| 2012/0009065 | A1 | 1/2012 | Harvey et al. | |
| 2014/0147243 | A1* | 5/2014 | Torkildsen | F04D 25/0686 415/1 |
| 2014/0215998 | A1* | 8/2014 | Goswami | F04D 29/384 60/39.1 |
| 2014/0301860 | A1 | 10/2014 | Ramm et al. | |
| 2014/0308130 | A1 | 10/2014 | Pasetto | |
| 2017/0022967 | A1 | 1/2017 | Hokelek | |
| 2017/0022994 | A1 | 1/2017 | Torkildsen | |
| 2018/0223875 | A1 | 8/2018 | Torkildsen | |

OTHER PUBLICATIONS

Extended European Search Report dated Aug. 1, 2018, for EP Application No. 18163200.1.

* cited by examiner

SURGE FREE SUBSEA COMPRESSOR

TECHNICAL FIELD

The present disclosure relates to subsea fluid processing machines. More particularly, the present disclosure relates to surge free rotating fluid processing machines such as subsea compressors.

BACKGROUND

Conventional turbo compressors are typically designed to compress dry gas. They normally consist of several stages, each including rotating impellers and static diffusers. The impellers are typically stacked on a shaft rotating at relatively high speed. In order to achieve good performance, i.e. large capacity, high pressure increase and good efficiency, the operating envelope becomes narrow. Also, a relatively complex control system is relied upon to ensure that the compressor always operates within acceptable boundaries and limits. In particular, conventional turbo compressors often rely on anti-surge control systems to maintain stable performance and mechanical integrity.

An anti-surge system is typically complex and costly. It typically uses fast acting valves and flow rate measurements, and therefore it is difficult to remotely control over long distances. Anti-surge systems are more difficult to implement for subsea applications. Anti-surge systems are further complicated in multiphase applications. Reliable fast action valves and flow rate measurements as used by compressor anti-surge control systems are currently inadequate for subsea multiphase applications.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a subsea fluid pressure increasing machine is described. The machine includes: an elongated member rotatable about a longitudinal axis;

a motor system mechanically engaged to the member so as to rotate the elongated member about a central longitudinal axis in the rotation direction; and a plurality of impellers each having a leading edge, a trailing edge and a chord line defined by a line between the leading and trailing edge. Each impeller is fixedly mounted to the first member such that a chord angle, defined by an angle between the chord line and the rotation direction, is less than or equal to a stall angle at which a maximum force is exerted on a fluid in a direction primarily parallel to the longitudinal axis when the member is rotated in the rotation direction.

According to some embodiments, the machine is a contra rotating design and includes a second elongated member rotatable about the longitudinal axis in a second rotation direction being opposite to the rotation direction; and a second plurality of impellers fixedly mounted to the second member such that the plurality of impellers are interleaved with the second plurality of impellers. Each of the second plurality of impellers also have chord angles that are less than or equal to the respective stall angles.

According to some embodiments, the fluid processing machine is of one of the following types: gas compressor, wet gas compressor, multiphase compressor, gas pump, liquid pump, multiphase pump, and electric submersible pump (e.g. either on the seafloor or in a wellbore.) According to some embodiments, the machine is free from an anti-surge control system.

According to some embodiments, a method of imparting force on a fluid is described. The method includes rotating an elongated member about a longitudinal axis in a rotation direction. The elongated member has a plurality of impellers mounted thereto each having a leading edge, a trailing edge and a chord line defined by a line between the leading and trailing edges. Each impeller is mounted such that a chord angle, defined by an angle between the chord line and the rotation direction, is less than or equal to a stall angle at which a maximum force is exerted on a fluid in a direction primarily parallel to the longitudinal axis.

According to some embodiments, a subsea fluid pressure increasing machine is described. The machine includes: an elongated member rotatable about a longitudinal axis; a motor system mechanically engaged to the member so as to rotate the elongated member about a central longitudinal axis in a rotation direction; and a plurality of impellers each having one or more gaps or openings that effectively increase a stall angle at which maximum force is exerted on a fluid in a direction primarily parallel to the longitudinal axis when the member is rotated in the rotation direction.

According to some embodiments, the gaps/openings allow fluid from a higher pressure side of the impellers to pass through to a lower pressure side of the impellers. This delays boundary layer separation from the lower pressure side of the impellers. According to some embodiments, each impeller includes a main blade portion and leading slat portion positioned in front of a leading edge of the main blade portion. A gap is formed by the space between the main blade portion and the leading slat portion. According to some embodiments, openings include a combination of holes and a slot(s) passing through each of the impellers. According to some embodiments, the machine is a wet gas compressor with contra rotating impeller stages.

According to some embodiments a method of imparting force on a fluid is described. The method includes rotating an elongated member about a longitudinal axis in a rotation direction. The elongated member has a plurality of impellers mounted thereto, each having one or more gaps or openings that effectively increase its stall angle.

According to some embodiments, one or more of the described systems and/or methods can be used in topside or subsea fluid processing equipment in an analogous fashion.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

The particulars shown herein are by way of example, and for purposes of illustrative discussion of the embodiments of the subject disclosure only, and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Further, like reference numbers and designations in the various drawings indicate like elements.

According to some embodiments, techniques for achieving a surge free compressor operation are described that do not rely on an anti-surge control system. Compressor surge occurs when the flow approaches the impeller blades with an incident angle that is so large that the flow is no longer able to stay attached to the low-pressure side of the impeller blade (i.e. the "suction" side of the impeller blade).

According to some embodiments, the impeller blades are positioned such that their chord angles are less than their respective stall angles. If all the impeller blades in the compressor meet this condition, then compressor surge does not occur for any positive flow rate. However, the low chord angles to meet the desired surge free operation can unduly constrain the nominal flow rate for the compressor. The resulting undesirable constraint on flow rate is so great that such designs are often not practical.

According to some embodiments, impellers having chord angles less than the stall angles are used in a contra-rotating impeller arrangement without static diffusers. The contra-rotating impeller arrangement provides for much larger nominal flow rates than conventional single rotating impeller arrangements with the same chord angles. Accordingly, a surge free design is provided without excessively compromising the nominal flow rate. According to some embodiments, a surge free compressor includes impellers such that the chord angles of all blade airfoils are less than the corresponding airfoils stall angles. By positioning successive impeller stages without static diffusers in a contra rotating arrangement, the nominal flow rate is sufficiently large to justify the low, surge-free chord angle design of the impellers. Thus, a compressor is provided that has reasonable nominal flow rates, is inherently surge-free for all positive flow rates and does not rely on separate surge control systems. Such a compressor is particularly suitable for remote, subsea and multiphase applications.

Note that as used herein the term "airfoils" refers to any impeller blade design, regardless of whether the processed fluid is air, another gas, a mixture of gas and liquid, or a liquid.

Figure 1:
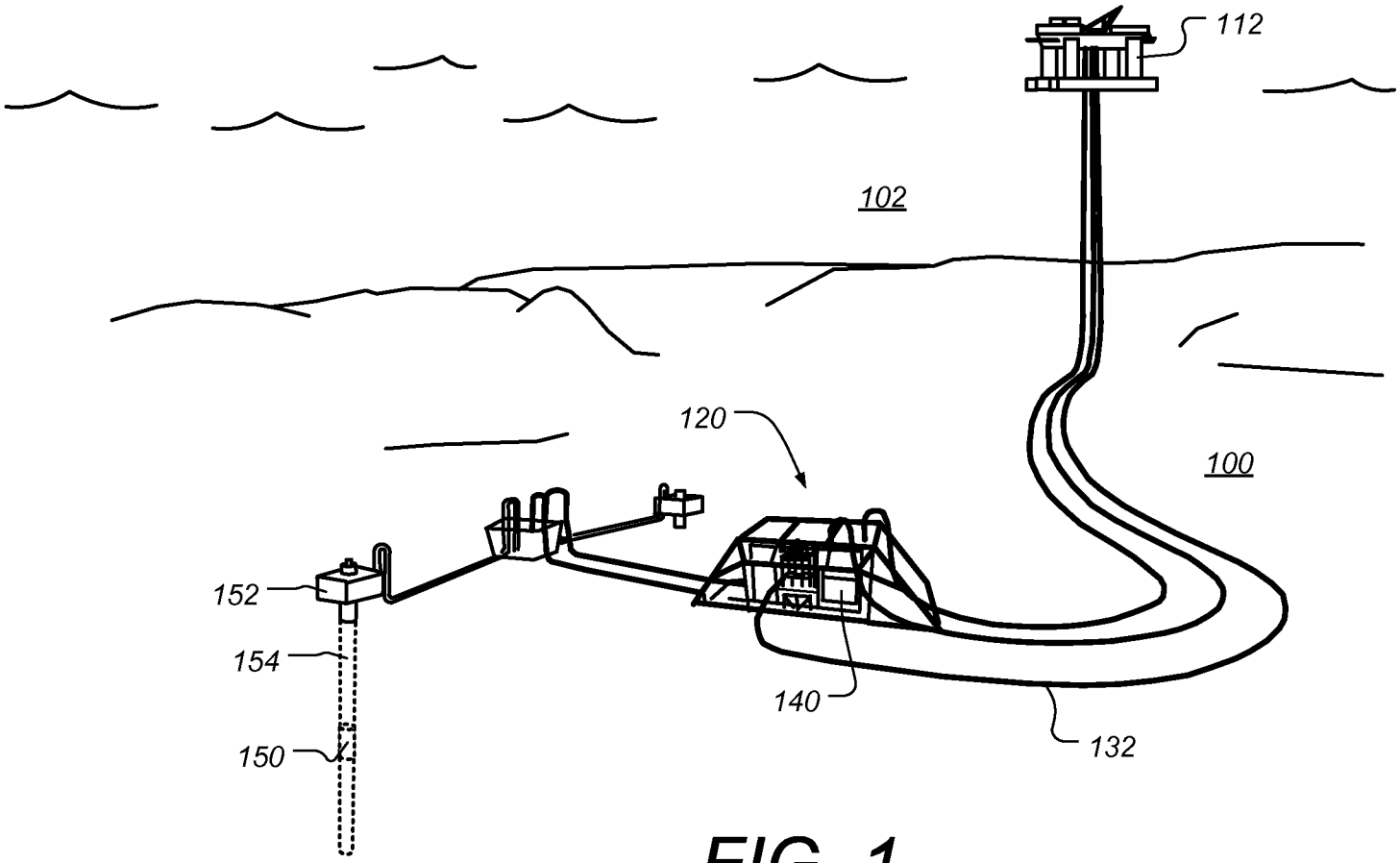
FIG. 1 is a diagram illustrating a subsea environment in which a surge free compressor can be deployed, according to some embodiments.

FIG. 1 is a diagram illustrating a subsea environment in which a surge free compressor can be deployed, according to some embodiments. On sea floor 100 a subsea station 120 is shown which is downstream of several wellheads being used, for example, to produce hydrocarbon-bearing fluid from a subterranean rock formation. Station 120 includes a subsea compressor module 140, which is powered by an electric motor, such as an induction motor or permanent magnet motor. According to some embodiments, compressor module 140 includes a surge-free contra rotating wet gas compressor. The station 120 is connected to one or more umbilical cables, such as umbilical 132. The umbilicals in this case are being run from a platform 112 through seawater 102, along sea floor 100 and to station 120. In other cases, the umbilicals may be run from some other surface facility such as a floating production, storage and offloading unit (FPSO), or a shore-based facility. The umbilical 132 can also be used to supply barrier and other fluids, and control and data lines for use with the subsea equipment in station 120. Although a compressor module 140 is shown in FIG. 1, according to some embodiments the module 140 can be configured for other subsea fluid processing functions, such as a subsea pumping module and/or a subsea separator module. In all embodiments described herein, it is understood that references to subsea compressors and compressor modules can alternatively refer to subsea pump and pumping modules. Furthermore, references herein to subsea compressors and subsea pumps should be understood to refer equally to subsea compressors and pumps for single phase liquids, single phase gases, or multiphase fluids. According to some embodiments, the surge free compressor designs described herein are used in connection with an electrical submersible pump (ESP) 150 which can either be located downhole, as shown wellbore 154 in FIG. 1, or it can be located in a subsea location such as on the sea floor in a Christmas tree at wellhead 152.

Figure 2:
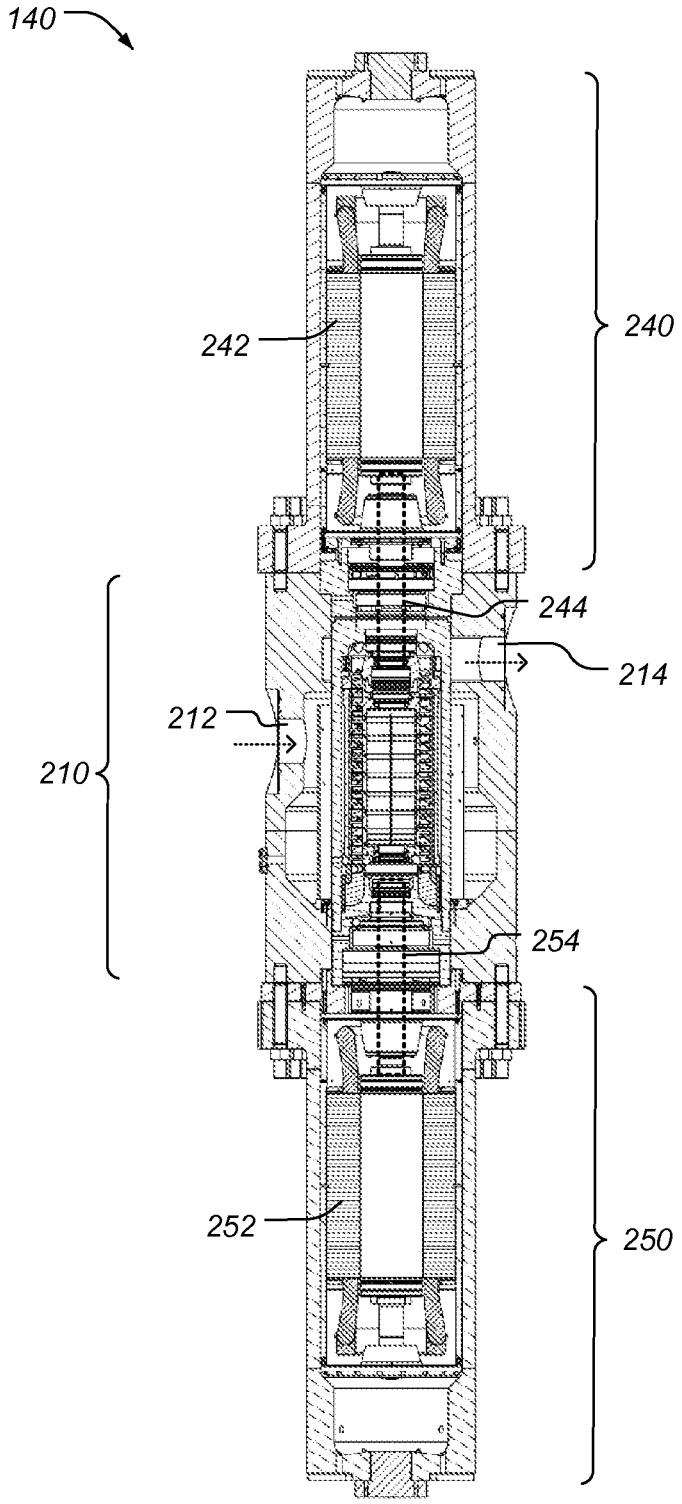
FIG. 2 is a cross-sectional view showing further details of a surge free wet gas compressor, according to some embodiments.

FIG. 2 is a cross-sectional view showing further details of a surge free wet gas compressor, according to some embodiments. Compressor module 140 includes an upper motor 240, lower motor 250 and a contra rotating compressor section 210. Lower motor 250 drives a lower shaft 254 that rotates an inner hub within compressor section 210 on which impellers are fixed. Likewise, upper motor 240 drives an upper shaft 244 that rotates an outer sleeve within compressor section 210 on which impellers are fixed. Notably, the rotation direction of the upper and lower shafts 244 and 254 are opposite to one another. Compressor section 210 has an inlet 212 and outlet 214. The compressor section 210 has interleaved rows of impellers mounted to the inner hub and outer sleeve that are stacked successively to each other and rotate in opposite directions.

Figure 3A:
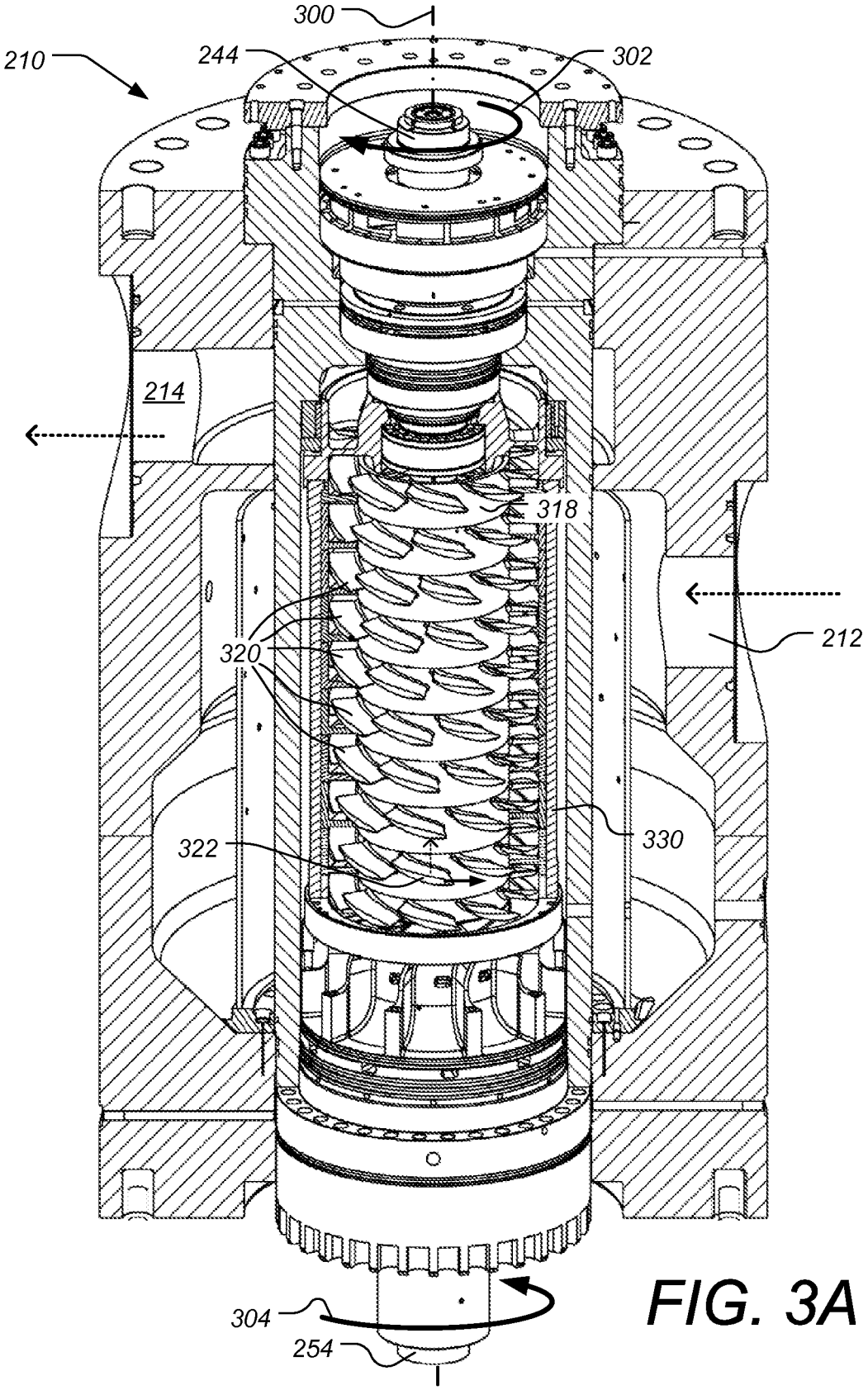
FIGS. 3A-3B are perspective cut away views of portions of a surge free contra rotating compressor, according to some embodiments.
Figure 3B:
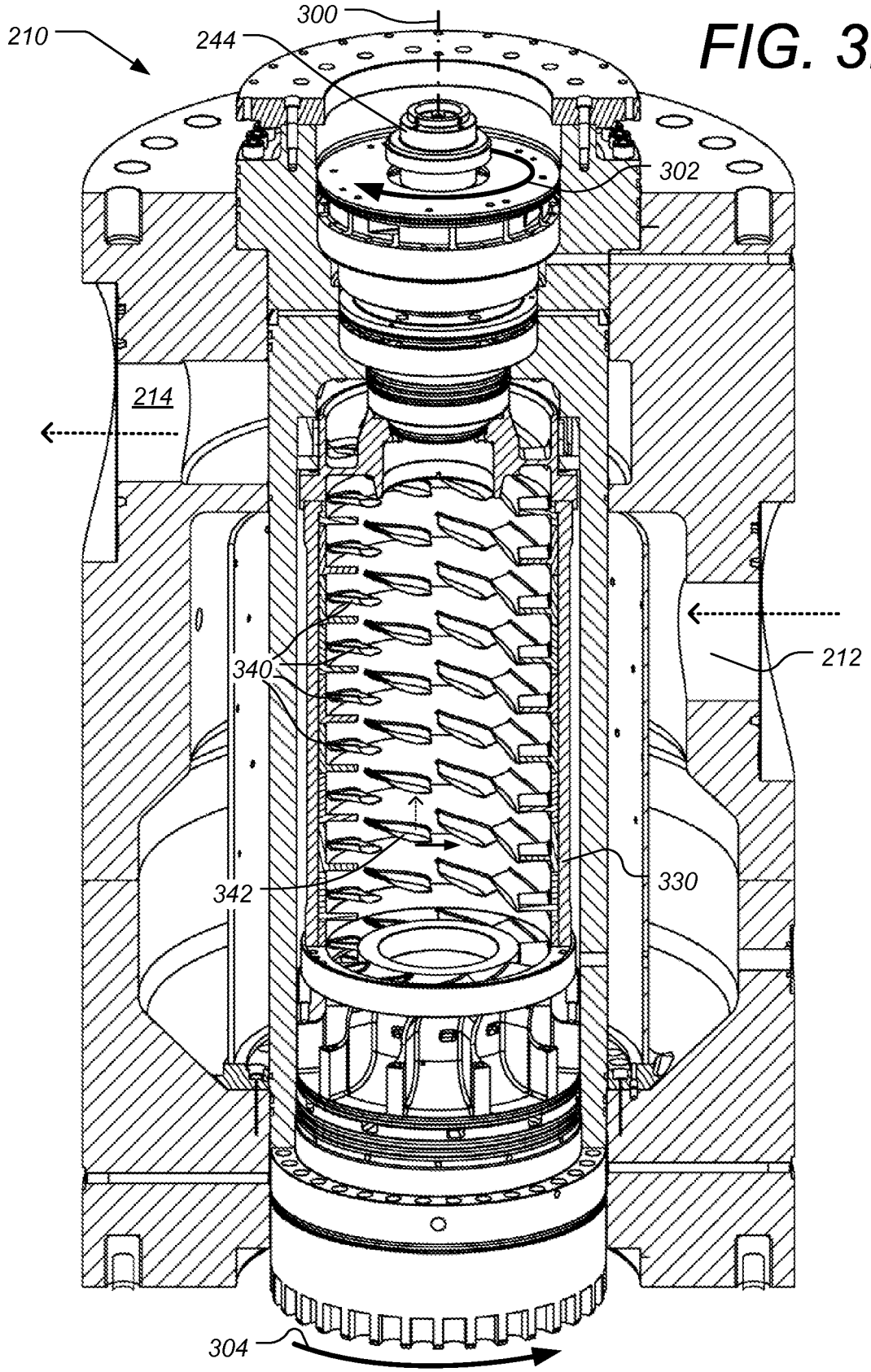

FIGS. 3A-3B are perspective cut away views of portions of a surge free contra rotating compressor, according to some embodiments. In FIG. 3A, the fluid enters the compressor section 210 via inlet 212. The fluid then passes around and/or through a perforated wall and through a manifold such it enters the impeller section from the bottom. The alternating rows of impellers are driven in opposite directions and together urge the fluid upwards, thus compressing the fluid to higher and higher pressures as it moves upwards. The compressed fluid exits the compressor section 210 via outlet 214. Also visible in FIG. 3A is lower shaft 254 that rotates about the central axis 300 in the direction shown by solid arrow 304. Lower shaft 254 drives inner hub 318 on which impellers 320 are fixedly mounted in distinct rows. Also visible is example impeller 322 that is being driven in the direction shown by the solid arrow and is shaped so as to urge fluid in an upwards direction shown by the dotted arrow. Outer sleeve 330 is also shown which is driven by upper shaft 244 in the direction shown by solid arrow 302.

In FIG. 3B, upper shaft 244 is shown that rotates about the central axis 300 in the direction shown by solid arrow 302. Also visible are impellers 340 mounted on the outer sleeve 330 as shown in distinct rows. Also visible is example impeller 342 that is being driven in the direction shown by the solid arrow and is shaped so as to urge fluid in an upwards direction shown by the dotted arrow. Through the use of interleaved rows of impellers mounted to the inner hub 318 and outer sleeve 330 that are stacked successively to each other and rotate in opposite directions, each row of impellers effectively forms a separate stage of the compressor. Note that in this design there are no guide vanes or diffusers between the successive adjacent stages. Rather, the fluid discharged from a stage rotating in one direction immediately enters into the stage rotating in the opposite direction and so on through a number of successive contra rotating stages.

Figure 4:
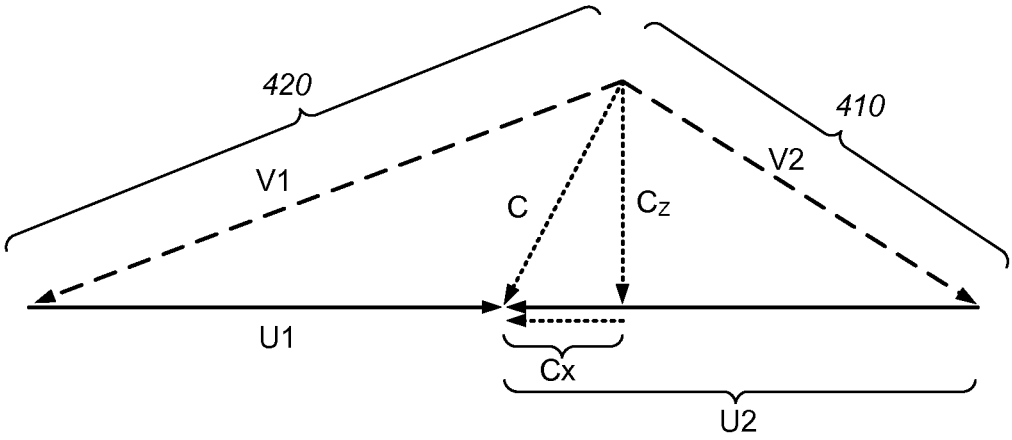
FIG. 4 is a diagram showing velocity triangles for an impeller in a contra rotating compressor, according to some embodiments.

FIG. 4 is a diagram showing velocity triangles for successive impeller stages in a contra rotating compressor, according to some embodiments. Shown are the outlet velocity triangle 410 for one impeller, and the impeller inlet velocity triangle 420 for a successive contra rotating impeller. Vector U (U1 for inlet and U2 for outlet) represents rotating velocity for the impellers, vectors V1 and V2 represent process flow velocity relative to the impellers, and vectors C1 and C2 represent the absolute fluid flow velocity such that: C=U+V. Note that the velocity triangles 410 and 420 are simplified for the purpose of illustration.

Figure 5:
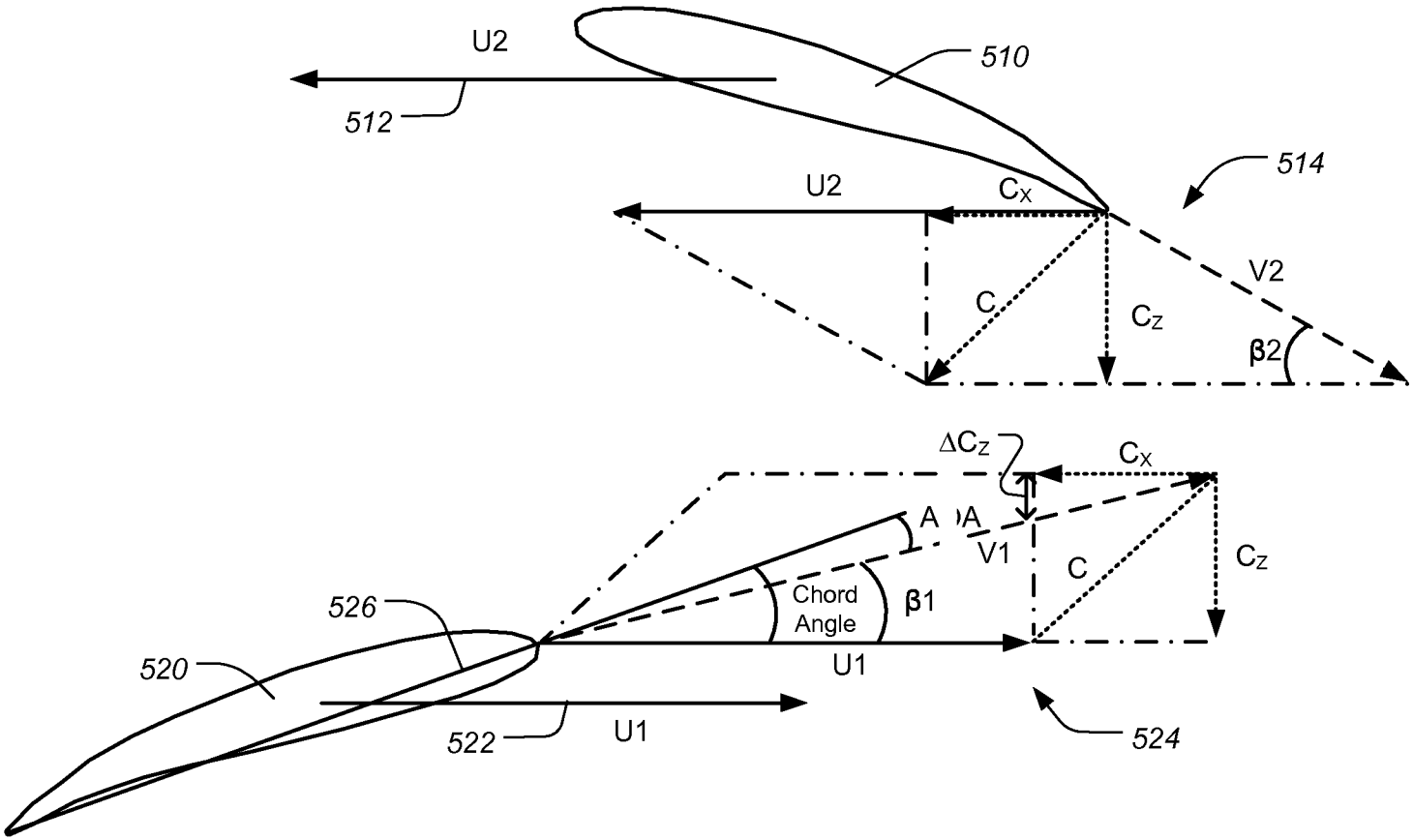
FIG. 5 is a diagram showing velocity vectors for two successive contra rotating impeller blade airfoils, according to some embodiments.

FIG. 5 is a diagram showing velocity vectors for two successive contra rotating impeller blade airfoils, according to some embodiments. Note that the axial spacing between impellers 510 and 520 has been exaggerated in order to give room for the illustrating velocity vector triangles. The outlet velocity vector 512 and velocity triangle 514 are shown for the outlet of impeller 510 and the inlet velocity vector 522 and velocity triangle 524 are shown for inlet of impeller 520. Referring to inlet velocity triangle 524 with the understanding that the flow rate is proportional to Cz, it can be observed that the maximum incident angle or angle of attack (AOA) possible for positive flow rates, occurs when the flow rate nears zero where AOA equals the blade airfoil chord angle. Note the chord angle is defined by chord line 526 which is drawn between the leading and trailing edges of the impeller. By designing the impellers such that the chord angles of all blade airfoils are less than the corresponding airfoils stall angles, surge cannot occur for any positive flow rate.

From FIG. 5 the following equation can be derived:

$$Cz=(U-Cx)\cdot\tan(\beta 1),$$

where Cx is negative for contra rotating impellers. The nominal flow rate can be defined at a zero incident angle, i.e. when V1 is tangential to the airfoil leading edge camber line, which for a cambered airfoil normally results in a small AOA with β1 close to the airfoil chord angle. As the nominal flow rate is proportional to Cz it can be observed from the above equation that the nominal flow rate increase with increasing magnitude of Cx for contra rotating impellers since Cx then is negative. In comparison, for a conventional single rotating impeller arrangement with static diffusers, Cx will ideally be zero but normally has a small positive value.

The relative increase in flow rate for a contra rotating impeller arrangement compared to an ideal single rotating impeller arrangement with static diffusers with the same impeller chord angles becomes:

$$\Delta Q\text{nom}/Q\text{nom}=-Cx/U>0;\ \text{for negative } Cx.$$

Thus, according to some embodiments, the use of contra rotating impeller stages allows for higher nominal flow rates which makes the surge free condition (each of impellers has its chord angle less than or equal to its stall angle) practical, especially for applications such as subsea deployments and/or wet gas compressors. Note that impellers 510 and 520 are shown to be arranged such that they force fluid downwards so as to be more understandable to those familiar with the concept of aerodynamic lift. According to some embodiments, however, such as shown in FIGS. 2, 3A and 3B, the impellers are inverted such that the fluid is forced in an upwards direction.

According to some embodiments, the impeller blades are cylindrical (i.e. its shape does not changing along the radial direction). In such cases the chord line can simply be drawn between the leading and trailing edges of the impeller. In some embodiments, however, the impeller blade is non-cylindrical in that its shape changes in the radial direction. In such cases a mean cord line is defined and can be used for calculating the chord angle. Examples of non-cylindrical shapes include slight changes in chord angle to accommodate the fact that locations of the impeller further from the central axis "see" a slightly higher fluid velocity. Other examples include impellers having elements to enhance stall characteristics such as slots which may not run the whole width of the impeller. Examples are shown in FIGS. 12A-12D, infra.

Figure 6:
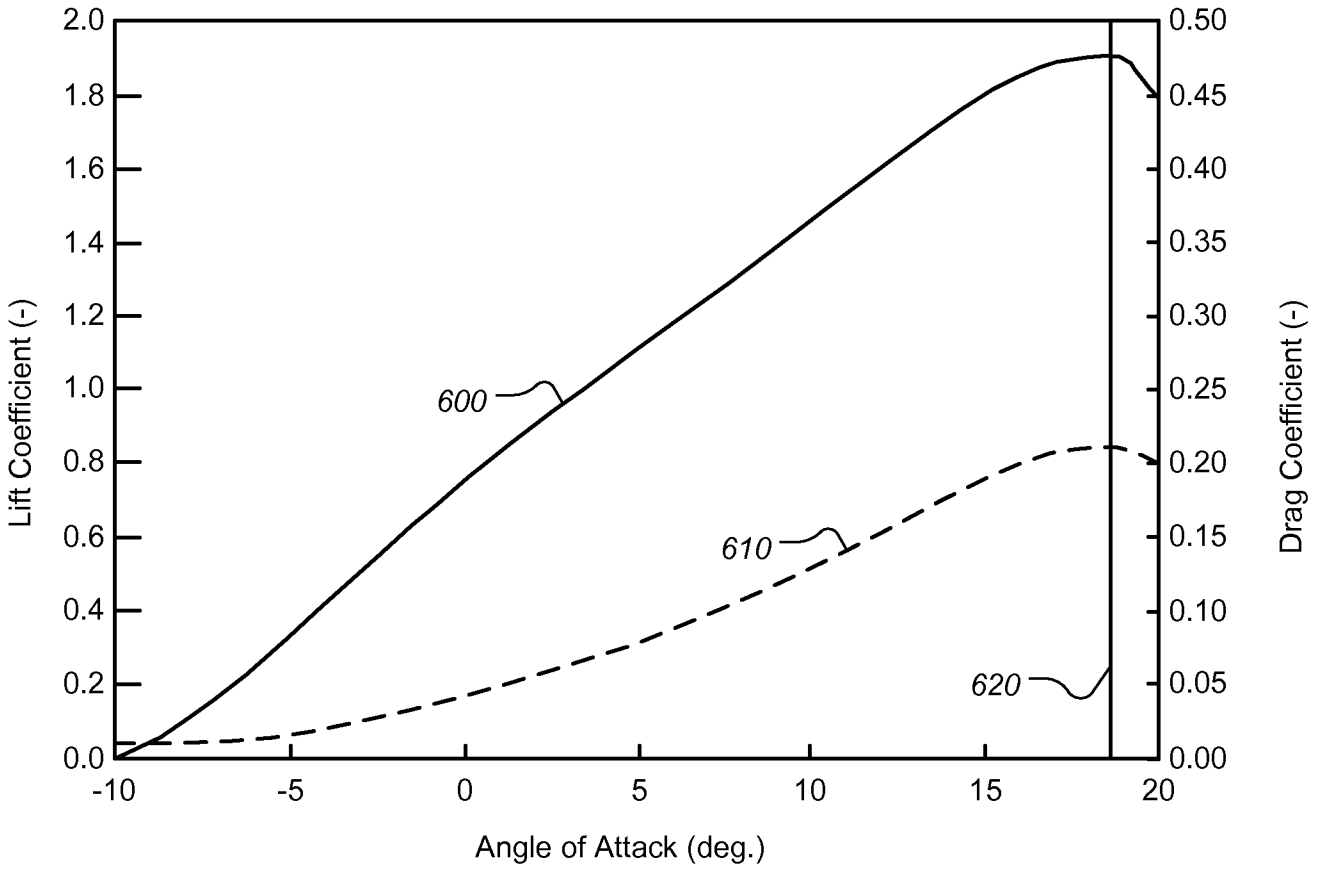
FIG. 6 is a plot showing lift and drag coefficients for a typical impeller, according to some embodiments.

FIG. 6 is a plot showing lift and drag coefficients for a typical impeller, according to some embodiments. In the plot, curve 600 represents the lift coefficient at various angles of attack while curve 610 represents the drag coefficient at various angles of attack. The stall angle 620 is also shown. The stall occurs when the flow approaches the impeller blades with an incident angle so large that it is no longer able to stay attached to the suction side of the impeller blade. As explained above, the maximum incident angle for the compressor impeller that is possible for positive flow rates occur for zero flow rate when the angles of attack equal the corresponding blade airfoil chord angles. By designing the impellers such that the chord angles of all blade airfoils are less than the corresponding airfoils stall angels, surge cannot occur for positive flow rates.

According to some embodiments, impeller blades having enhanced stall characteristics are provided. In particular, by increasing the stall angle of the impellers blades, a surge free design is practical without excessively compromising the nominal flow rate. Increasing the stall angle of impeller blades can be accomplished in a number of ways, some illustrative examples of which are described herein.

In general, impeller blades and airfoils that are designed for high maximum lift will also have high stall angles. A number of different impeller blade/airfoil designs and design features are available for this purpose. According to some embodiments, further increase in the impeller blade/airfoil stall angle is achieved by introducing a slot arrangement near the leading edge of the impeller blade/airfoil. According to some other embodiments, an increase in the impeller blade/airfoil stall angle is accomplished by using multiple elements for each impeller blade/airfoil. By applying impeller blade/airfoils with increased stall angles, the nominal flow rate of the compressor can be made sufficient large so as to justify surge-free chord angle positioning of the impellers.

Figure 7:
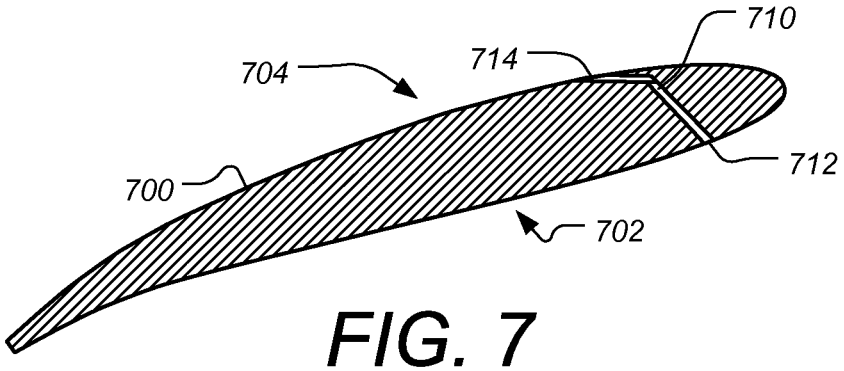
FIG. 7 is a cross-section diagram of an impeller blade having enhanced stall characteristics, according to some embodiments.

FIG. 7 is a cross-section diagram of an impeller blade having enhanced stall characteristics, according to some embodiments. Impeller blade 700 is shown having a high pressure side 702 and a low pressure side 704. The impeller blade 700 includes a conduit 710 that has an inlet 712 on the high pressure side 702 and an outlet 714 on the low pressure side 704. According to some embodiments, the conduit 710 is a simple circular orifice through the impeller blade 700. According to other embodiments, the conduit 710 is slot shaped and spans a significant width of the impeller blade 700. According to some yet other embodiments, the conduit shapes are more complex. In some embodiments, for example, the lower portion of the conduit 710 (i.e. nearer to the inlet 712) is a circular orifice and the upper portion of the conduit 710 (i.e. near to the outlet 714) is a slot that opens to multiple other orifices that are not visible in FIG. 7.

Figure 8A:
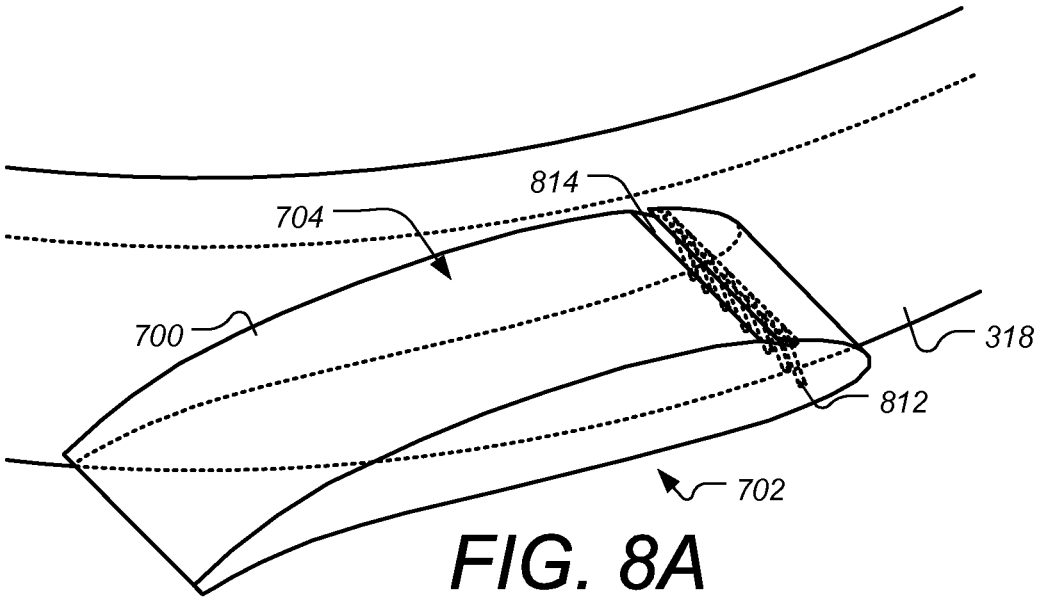
FIGS. 8A, 8B and 8C are diagrams illustrating further aspects of an impeller blade having enhanced stall characteristics, according to some embodiments.
Figure 8B:
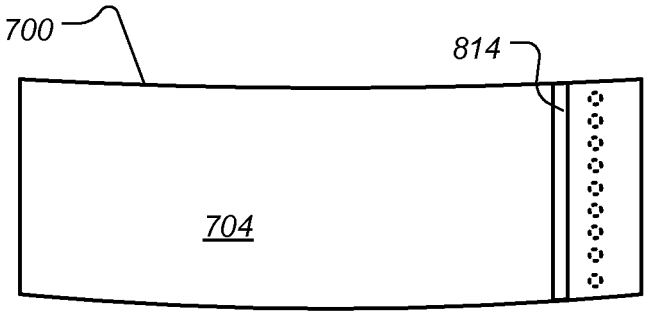
Figure 8C:
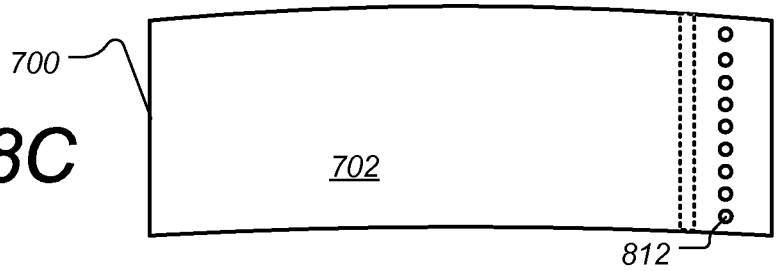

FIGS. 8A, 8B and 8C are diagrams illustrating further aspects of an impeller blade having enhanced stall characteristics, according to some embodiments. FIG. 8A is a prospective view of impeller blade 700. In this case impeller blade 700 is cylindrical in shape and is shown mounted to an exterior surface of inner hub 318 (also shown in FIGS. 3A and 3B). Also visible are multiple orifices 812 that lead from the higher pressure side 702 to a slot 814 that extends to the lower pressure side 704. Note the orifices 812 each have an inlet on the higher pressure side 702 that corresponds to the inlet 712 in FIG. 8A, and slot 814 has an outlet on the lower pressure side 704 that corresponds to the outlet 714. FIGS. 8B and 8C are top and bottom views of impeller blade 700.

According to some embodiments, the orifices 812 are circular holes with diameters of about 2% of the airfoil chord length are distributed along a straight line from hub 318 to tip on the high pressure side 702 of the impeller blade 700 at the approximate location of the stagnation point for incipient boundary layer separation at a high angle of attack. According to some embodiments, the holes 812 penetrate about 75% of the impeller blade thickness before they are manifolded in a slot 814 pointing out and backwards on the suction side 714 of the impeller blade 700 with an angle of approximately 20 degrees to the impeller blade surface and located upstream of location of incipient boundary layer separation at a high angle of attack.

The pressure difference between the high pressure 702 and suction (or low pressure) side 704 of the impeller blade will cause a positive flow from the pressure side 702 through the holes 812 and slot 814 to the suction side 704 of the impeller blade, thereby helping to delay boundary layer separation.

Figure 9:
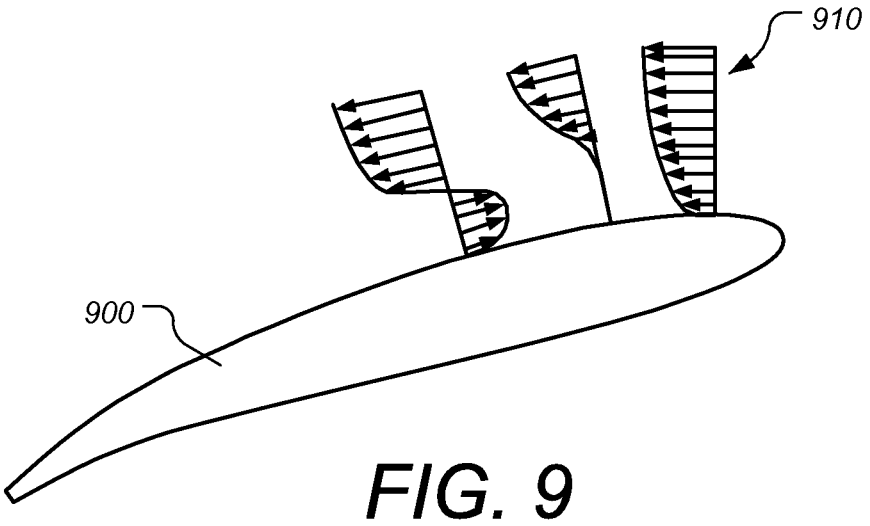
FIG. 9 shows an impeller blade without additional stall angle increasing enhancements.
Figure 10:
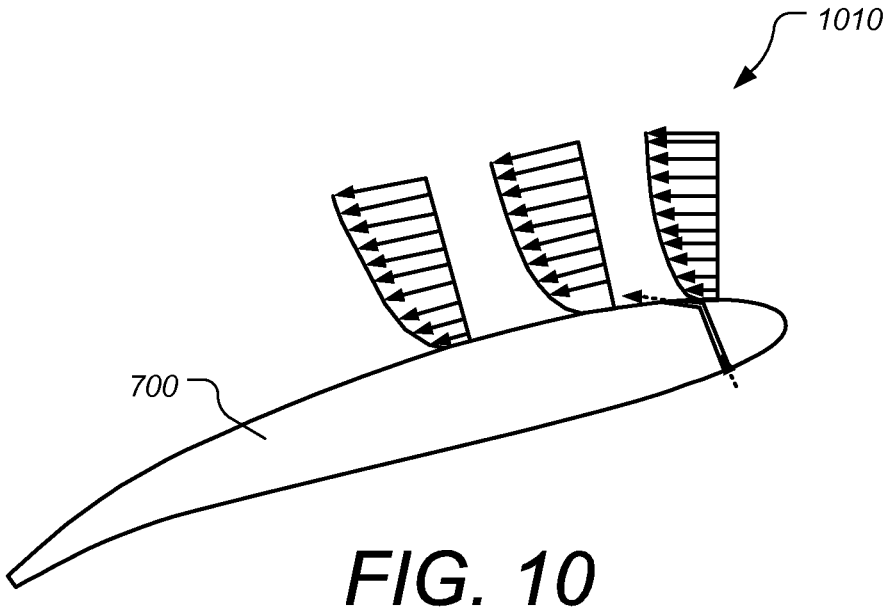
FIG. 10 shows an impeller blade with additional stall angle increasing enhancements, according to some embodiments.

FIG. 9 shows an impeller blade without additional stall angle increasing enhancements. As can be seen by the aerodynamic indicators 910, significant boundary layer separation exists at the chord angle shown on un-enhanced impeller blade 900. FIG. 10 shows an impeller blade with additional stall angle increasing enhancements, according to some embodiments. The impeller blade 700 has orifices that allow fluid to pass from the higher pressure side to the lower pressure side. As can be seen by the aerodynamic indicators 1010, the orifices are effective in preventing boundary layer separation when enhanced impeller blade 700 is at the same chord angle as unenhanced impeller blade 900 in FIG. 9.

Figure 11:
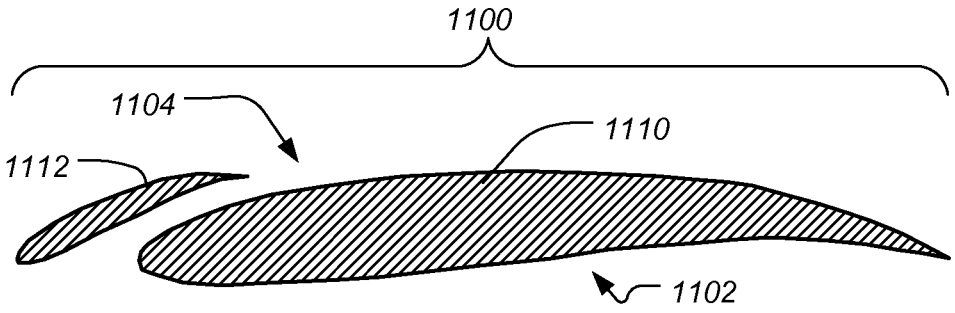
FIG. 11 is a cross section showing an example of a multi-element impeller blade, according to some embodiments.

FIG. 11 is a cross section showing an example of a multi-element impeller blade, according to some embodiments. Impeller 1100 is shown made up of two elements: main impeller blade 1110 and fixed slat 1112. The gap between the main blade 1110 and slat 1112 allows fluid to pass from the high pressure side 1102 to the low pressure side 1104, which delays boundary layer separation and increases the effective stall angle of impeller 1100. Various multi-element airfoil gap effects are known, including: slat-effect; circulation effect; dumping effect; off-the-surface pressure recovery effect; and fresh-boundary-layer effect. According to some embodiments, one or more of these effects are used in fluid compressors to delay boundary layer separation and increase impeller blade maximum "lift."

By using one or more stall angle enhancement techniques such as orifices, slots, slats, and gaps, the stall angle of the compressor impellers can be increased. Increasing the stall angles of the impellers allows for larger impeller chord angles and higher nominal flow rates while still maintaining surge free performance without reliance on anti-surge systems. According to some embodiments, the stall angle enhancements described increase nominal flow rates enough that simple rotation (i.e. non-contra rotating) compressor designs can be used. According to some other embodiments, the stall angle enhancements described are used in combination with a contra rotating arrangement to even further boost surge-free nominal flow rates over what would achievable without such enhancements.

Figure 12A:
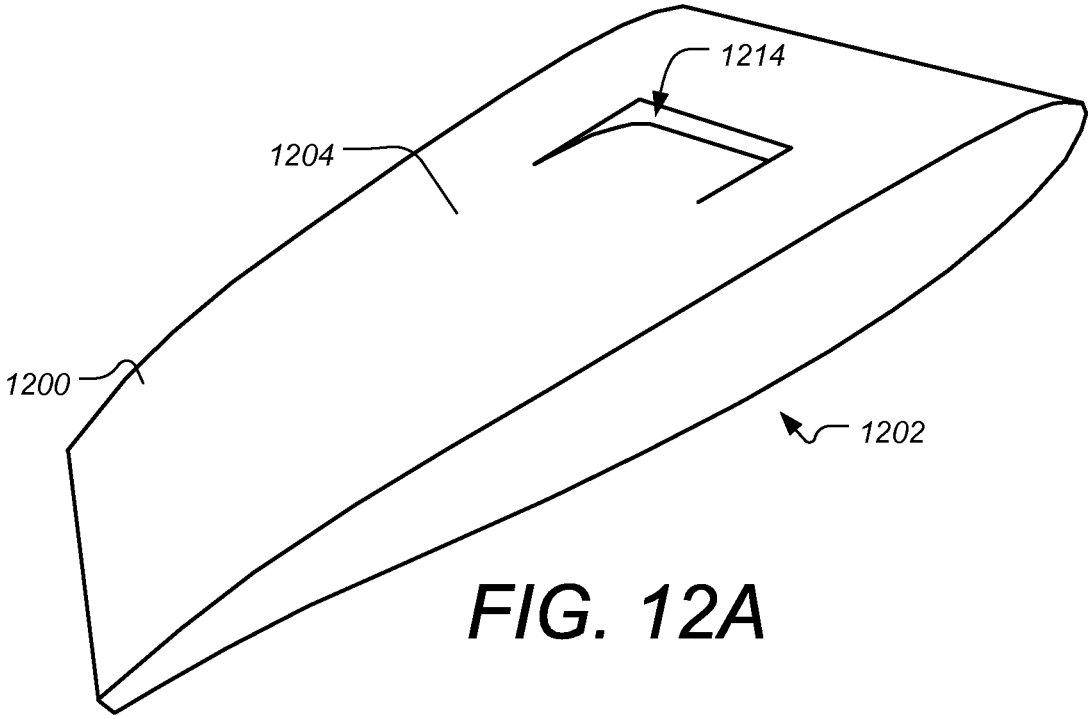
FIGS. 12A-12D are prospective and sectional perspective views showing examples of a slotted impeller blade, according to some embodiments.
Figure 12B:
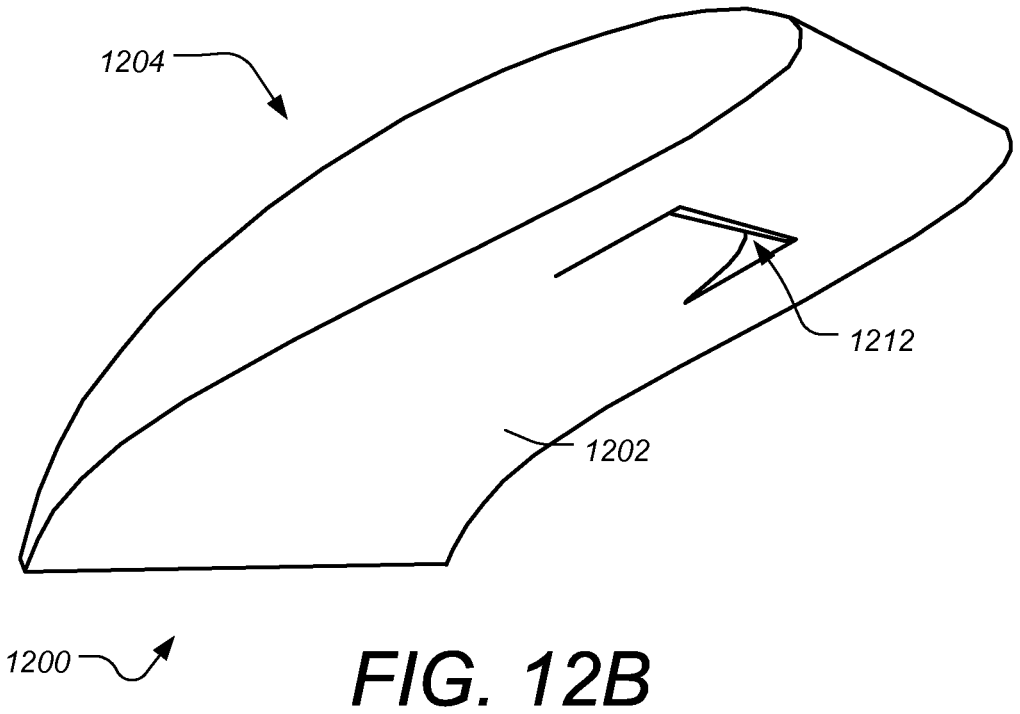
Figure 12C:
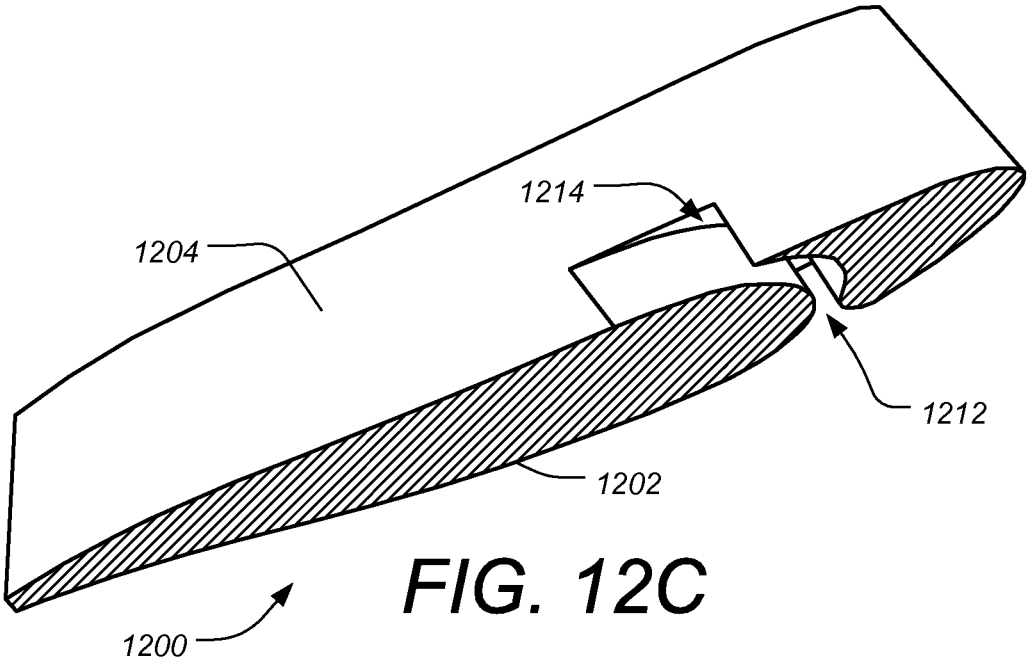
Figure 12D:
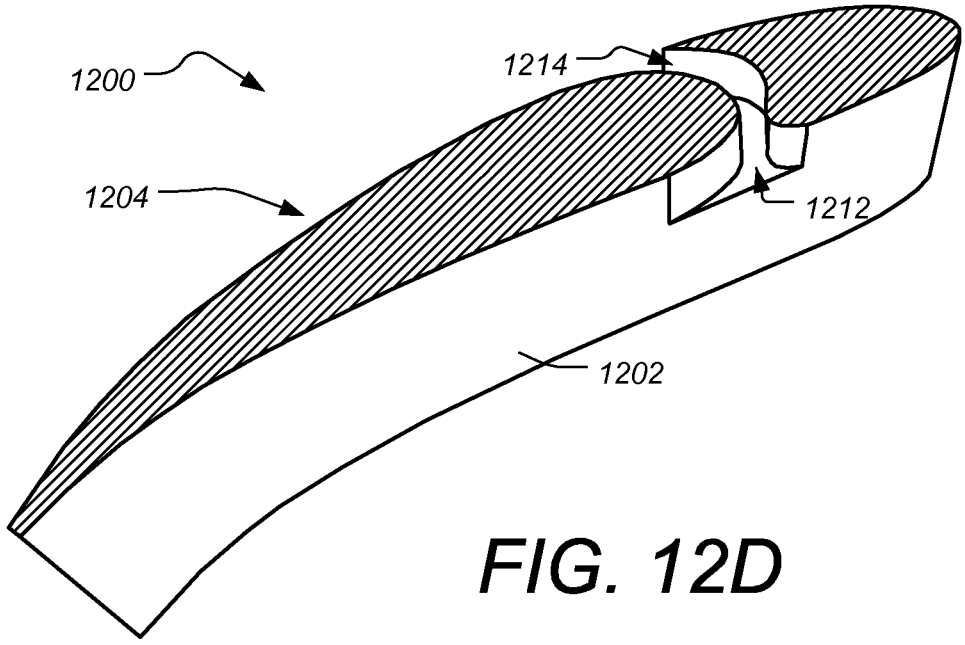

FIGS. 12A-12D are prospective and sectional perspective views showing examples of a slotted impeller blade, according to some embodiments. The impeller blade 1200 in this case has a large slot having a high pressure opening 1212 on the higher pressure side 1202 and a low-pressure opening 1214 on the lower pressure side 1204. FIGS. 12C and 12D, sectional perspective views are provided so that the details of the shape of the central slot can be seen. The slot allows fluid to pass from the high pressure side 1202 to the low pressure side 1204, which delays boundary layer separation and increases the effective stall angle of impeller 1200. According to some other embodiments, the slot is not in the center of the impeller as shown in FIGS. 12A and 12B. Rather in some cases the slot can be provided closer to the hub or sleeve wall. FIGS. 12C and/or 12D could represent such embodiments. In other embodiments, the slot could be provided closer to the either the leading or trailing edge of the impeller. In yet other embodiments multiple slots can be located at various positions relative to the hub or sleeve wall and/or leading or trailing edge.

Figure 13A:
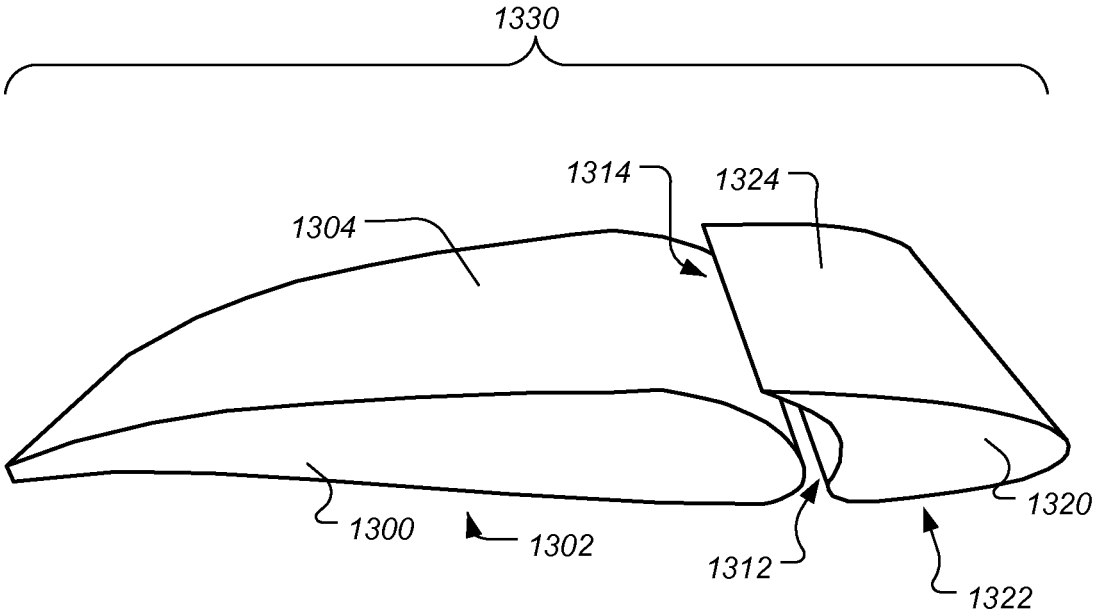
FIGS. 13A-13C are prospective views showing examples of a multi-element impeller blade, according to some embodiments.
Figure 13B:
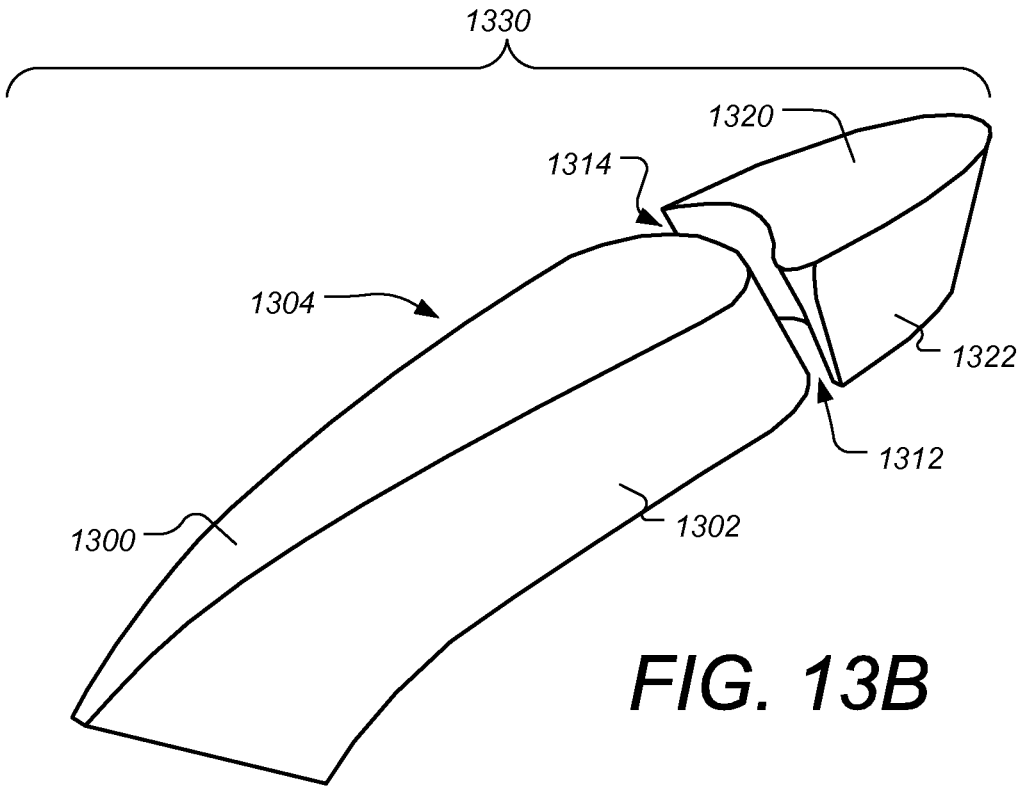
Figure 13C:
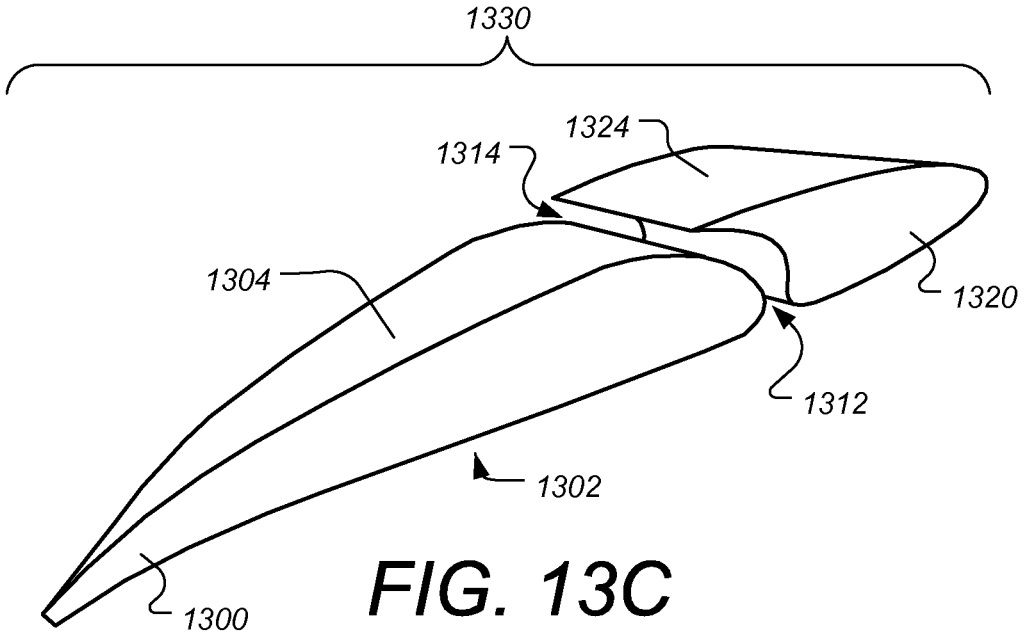

FIGS. 13A-13C are prospective views showing examples of a multi-element impeller blade, according to some embodiments. The impeller 1330 is similar in design to that shown in FIG. 11, and includes a trailing element 1300 and a leading element 1320 with a slot formed therebetween. The trailing element 1300 includes lower pressure side 1302 and higher pressure side 1304. Similarly, leading element 1320 includes lower pressure side 1320 and higher pressure side 1324. The slot formed between the leading and trailing element includes a higher pressure inlet 1312 and lower pressure outlet 1314. The gap between the trailing element 1300 and leading element 1320 allows fluid to pass from the higher pressure side of impeller 1330 to the lower pressure side, which delays boundary layer separation and increases the effective stall angle of impeller 1330.

While the subject disclosure is described through the above embodiments, it will be understood by those of ordinary skill in the art that modification to and variation of the illustrated embodiments may be made without departing from the inventive concepts herein disclosed. Moreover, while some embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A subsea fluid pressure increasing machine comprising:

an elongated member rotatable about a longitudinal axis;

a motor system mechanically engaged to the member so as to rotate the elongated member about a central longitudinal axis in a rotation direction;

a plurality of impellers each having a leading edge, a trailing edge and a chord line defined by a line between the leading and trailing edges, each impeller being fixedly mounted to the first member such that a chord angle defined by an angle between the chord line and the rotation direction is less than or equal to a stall angle at which a maximum force is exerted on a subsea fluid in a direction primarily parallel to the longitudinal axis when the member is rotated in the rotation direction;

a second elongated member rotatable about the longitudinal axis in a second rotation direction being opposite to the rotation direction; and a second plurality of impellers fixedly mounted to the second member such that the plurality of impellers are interleaved with the second plurality of impellers, each of the second plurality of impellers having and a chord line defined by a line between leading and trailing edges thereof and a chord angle defined by an angle between the chord line and the second rotation direction, which is less than or equal to a stall angle at which maximum force is exerted on the subsea fluid in a direction primarily parallel to the longitudinal axis when the second member is rotated in the second rotation direction wherein the elongated members, the motor system, and the pluralities of impellers are configured for subsea deployment;

wherein each of the plurality of impellers has multiple orifices that extend through the impeller from a high pressure side of the impeller to a slot that extends to a low pressure side of the impeller, that effectively increase the stall angle of the impeller.

2. The machine of claim 1, wherein at least some of the impellers are non cylindrical in shape and the chord line is a mean chord line for the non cylindrically shaped impellers.

3. The machine of claim 1 wherein the fluid processing machine is of the type selected from a group consisting of: gas compressor, wet gas compressor, multiphase compressor, gas pump, liquid pump, multiphase pump, and electric submersible pump.

4. The machine of claim 3 wherein the fluid processing machine is an electric submersible pump configured for deployment on a seafloor or in a wellbore.

5. The machine of claim 1 wherein the machine is free from an anti-surge control system.

6. A method of imparting force on a subsea fluid comprising rotating an elongated member about a longitudinal axis in a rotation direction, the elongated member having fixedly mounted thereto a plurality of impellers each having a leading edge, a trailing edge and a chord line defined by a line between the leading and trailing edges, each impeller being mounted such that a chord angle defined by an angle between the chord line and the rotation direction is less than or equal to a stall angle at which a maximum force is exerted on a subsea fluid in a direction primarily parallel to the longitudinal axis; and rotating a second elongated member about the longitudinal axis in a second rotation direction that is opposite to the rotation direction; wherein the second elongated member having fixedly mounted thereto a second plurality of impellers each having a leading edge, a trailing edge and a chord line defined by a line between the leading and trailing edges, each impeller being mounted such that a chord angle defined by an angle between the chord line and the rotation direction is less than or equal to a stall angle wherein each of the plurality of impellers has multiple orifices that extend through the impeller from a high pressure side of the impeller to a slot that extends to a low pressure side of the impeller, that effectively increase the stall angle of the impeller.

7. The method of claim 6 wherein the method does not rely on an anti-surge control system.

8. The method of claim 6 wherein the elongated member and impellers are configured for subsea deployment in a machine of the type selected from a group consisting of: gas compressor, wet gas compressor, multiphase compressor, gas pump, liquid pump, multiphase pump, and electric submersible pump.

* * * * *